US009839992B2

(12) United States Patent
Xue et al.

(10) Patent No.: US 9,839,992 B2
(45) Date of Patent: Dec. 12, 2017

(54) DEBURRING BRUSH

(71) Applicants: Bowen Xue, Qinhuangdao (CN); Jiandong Guo, Qinhuangadao (CN); Yongning Wang, Qinhuangado (CN); Zhihua Zhu, Qinhuangdao (CN); Changhai Li, Qinhuangdao (CN)

(72) Inventors: Bowen Xue, Qinhuangdao (CN); Jiandong Guo, Qinhuangadao (CN); Yongning Wang, Qinhuangado (CN); Zhihua Zhu, Qinhuangdao (CN); Changhai Li, Qinhuangdao (CN)

(73) Assignee: KSM CASTINGS QINHUANGDAO Co., LTD., Qinhuangdao, Hebei Province (CN)

( * ) Notice: Subject to any disclaimer, the term of this patent is extended or adjusted under 35 U.S.C. 154(b) by 0 days.

(21) Appl. No.: 14/675,869

(22) Filed: Apr. 1, 2015

(65) Prior Publication Data

US 2015/0306740 A1 Oct. 29, 2015

(30) Foreign Application Priority Data

Apr. 25, 2014 (CN) ..... 2014 1 0169924

(51) Int. Cl.

| | |
|---|---|
| ***B24D 13/10*** | (2006.01) |
| ***A46B 5/00*** | (2006.01) |
| ***B24B 9/04*** | (2006.01) |
| ***A46B 7/04*** | (2006.01) |
| ***A46B 9/02*** | (2006.01) |

(52) U.S. Cl.

CPC ..... *B24D 13/10* (2013.01); *A46B 7/04* (2013.01); *A46B 9/026* (2013.01); *B24B 9/04* (2013.01); *A46B 2200/3086* (2013.01); *A46B 2200/3093* (2013.01)

(58) Field of Classification Search

CPC ..... B24D 13/10; B24B 9/04; A46B 5/0095

See application file for complete search history.

(56) References Cited

U.S. PATENT DOCUMENTS

| | | | | |
|---|---|---|---|---|
| 5,507,061 | A * | 4/1996 | Miyazaki | A47L 11/162 15/49.1 |
| 8,602,220 | B1 * | 12/2013 | Porter | A46B 15/0026 209/215 |
| 2012/0270483 | A1 * | 10/2012 | Bae | B24D 7/066 451/540 |

FOREIGN PATENT DOCUMENTS

| | | | |
|---|---|---|---|
| JP | 2007331085 | A * | 12/2007 |
| JP | 2008000853 | A * | 1/2008 |
| JP | 2008049446 | A * | 3/2008 |

* cited by examiner

*Primary Examiner* — Joseph J Hail
*Assistant Examiner* — Joel Crandall
(74) *Attorney, Agent, or Firm* — AKC Patents, LLC; Aliki K. Collins

(57) ABSTRACT

The present invention discloses a deburring brush, comprising a pressing plate, jacking posts, copper sleeves, gaskets, guide posts, springs and bristle units. When the bristle units need replacement, it only needs to place the deburring brush on the ground and then press down edges of the front side of a top plate, so that all the bristle units will fall off against the suction force of strong magnets under the action of each jacking post. According to the present invention, it avoids being time consuming and labor intensive due to removing the bristle units one by one by using a screw driver or other similar devices while replacing the bristle units, and at the same time the replacing speed of bristles is greatly increased.

1 Claim, 1 Drawing Sheet

DEBURRING BRUSH

TECHNICAL FIELD

The present invention relates to a surface treatment device, more particularly to a metal surface treatment device.

BACKGROUND ART

During manufacturing process of aluminum alloy wheels, deburring cost accounts for a very large part of the overall cost due to huge consumption of deburring brushes. More and more enterprises have begun exploring and developing a variety of novel deburring brushes to reduce the deburring cost. A deburring brush with replaceable bristles is a future development trend of wheel deburring brushes due to its flexibility, its chassis part being reusable, thus greatly reducing the cost. However, how to make it convenient to disassemble the shortened bristles while reducing the cost is a new technical problem we are faced with.

INVENTION CONTENTS

An object of the present invention is providing a wheel deburring brush with conveniently replaceable bristles.

To achieve the above object, the present invention adopts the following technical solution: a deburring brush comprises a pressing plate, jacking posts, copper sleeves, gaskets, guide posts, springs, a bottom plate, magnets, a top plate and bristle units. The magnet is fixed between the bottom plate and the top plate, and the magnets grip the bristle units, thus forming a body of the deburring brush.

The guide posts are fixed below the bottom plate, and the copper sleeves cooperating with the guide posts are embedded on the pressing plate; the pressing plate, above which are mounted the jacking posts, is fixed between the springs and the gaskets at the ends of the guide posts; and the top ends of the jacking posts pass through holes of the bottom plate and the magnets, and are in contact with the bottoms of the bristle units.

When the bristle units need replacement, it only needs to place the deburring brush on the ground and then press down edges of the front side of the top plate, so that all the bristle units will fall off against the suction force of the strong magnets under the action of each jacking post.

According to the present invention, it avoids being time consuming and labor intensive due to removing the bristle units one by one by using a screw driver or other similar devices while replacing the bristle units, and at the same time the replacing speed of bristles is greatly increased.

Figure 1:
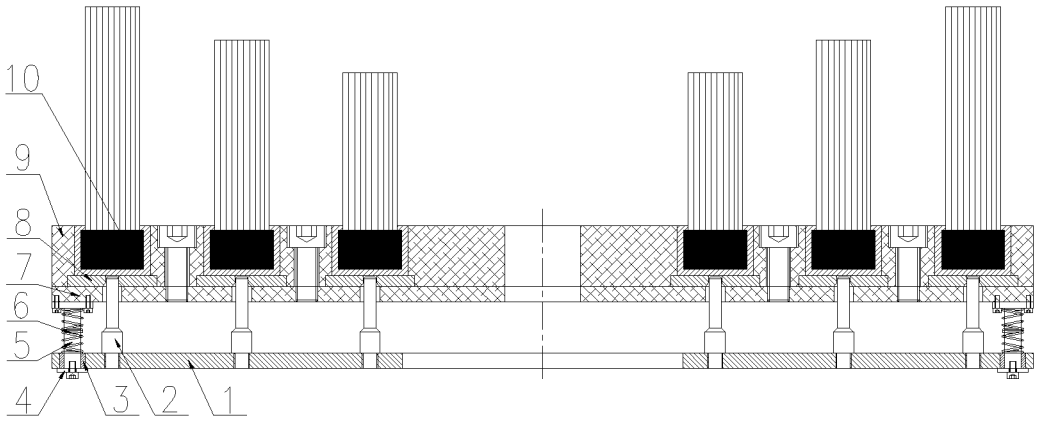
FIG. 1 is a front view of an improved displaceable wheel deburring brush according to the present invention.
Figure 2:
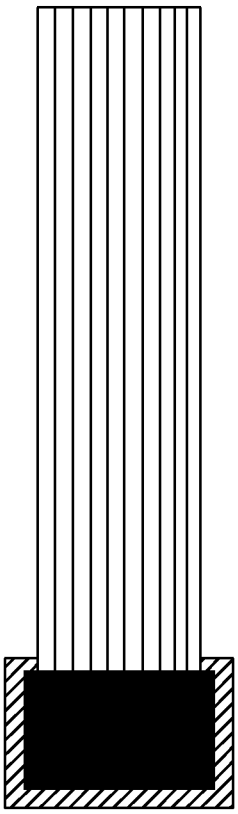
FIG. 2 is a front view of a bristle unit of an improved displaceable wheel deburring brush according to the present invention.

In the figures, 1—pressing plate, 2—jacking post, 3—copper sleeve, 4—gasket, 5—guide post, 6—spring, 7—bottom plate, 8—magnet, 9—top plate, 10—bristle unit.

DETAILED DESCRIPTION

Details and operation of the specific device provided by the present invention will be described below in conjunction with the accompanying drawings.

The deburring brush comprises a pressing plate 1, jacking posts 2, copper sleeves 3, gaskets 4, guide posts 5, springs 6, a bottom plate 7, magnets 8, a top plate 9 and bristle units 10. The magnets 8 are fixed between the bottom plate 7 and the top plate 9, and the magnets 8 grip the bristle units 10, thus forming a body of the deburring brush.

The guide posts 5 are fixed below the bottom plate 7, and the copper sleeves 3 cooperating with the guide posts 5 are embedded on the pressing plate 1; the pressing plate 1, above which are mounted the jacking posts 2, is fixed between the springs 6 and the gaskets 4 at the ends of the guide posts 5; and the top ends of the jacking posts 2 pass through holes of the bottom plate 7 and the magnets 8, and are in contact with the bottoms of the bristle units 10.

During operation, when the bristle units 10 need replacement, it only needs to place the deburring brush on the ground and then press down edges of the front side of the top plate 9, so that all the bristle units 10 will fall off against the suction force of the magnets 8 under the action of each jacking post 2.

The invention claimed is:

1. A deburring brush, comprising a pressing plate (1), jacking posts (2), copper sleeves (3), gaskets (4), guide posts (5), springs (6), a bottom plate (7), magnets (8), a top plate (9) and bristle units (10), wherein the magnets (8) are fixed between the bottom plate (7) and the top plate (9), and wherein the magnets (8) grip the bristle units (10), thus forming a body of the deburring brush; and wherein the guide posts (5) are fixed below the bottom plate (7), and the copper sleeves (3) cooperating with the guide posts (5) are embedded on the pressing plate (1); and wherein the pressing plate (1), above which are mounted the jacking posts (2), is fixed between the springs (6) and the gaskets (4) at the ends of the guide posts (5); and wherein the top ends of the jacking posts (2) pass through holes of the bottom plate (7) and the magnets (8), and are in contact with the bottoms of the bristle units (10); and wherein during operation, when the bristle units (10) need replacement, the deburring brush is capable of removing the bristle units by placing the brush on a ground and then pressing down the edges of the front side of the top plate (9) so that all the bristle units (10) will fall off against the magnetic force of the magnets (8) under the action of the jacking posts (2).

* * * * *